US009166343B1

(12) United States Patent
Jeon et al.

(10) Patent No.: US 9,166,343 B1
(45) Date of Patent: Oct. 20, 2015

(54) MEZZANINE RECEPTACLE CONNECTOR

(71) Applicant: Tyco Electronics Corporation, Berwyn, PA (US)

(72) Inventors: James Myoungsoo Jeon, Harrisburg, PA (US); Chad W. Morgan, Carneys Point, NJ (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/283,631

(22) Filed: May 21, 2014

(30) Foreign Application Priority Data

Apr. 22, 2014 (CN) ..... 2014 1 0163016

(51) Int. Cl.
*H01R 13/648* (2006.01)
*H01R 13/6587* (2011.01)
*H01R 12/73* (2011.01)
*H01R 12/50* (2011.01)

(52) U.S. Cl.
CPC ..... *H01R 13/6587* (2013.01); *H01R 12/73* (2013.01); *H01R 23/688* (2013.01)

(58) Field of Classification Search
CPC ..... H01R 23/688
USPC ..... 439/607.05
See application file for complete search history.

(56) References Cited

U.S. PATENT DOCUMENTS 4,611,867 A * 9/1986 Ichimura et al. ..... 439/607.07
5,201,855 A * 4/1993 Ikola ..... 439/607.14
6,435,913 B1 8/2002 Billman
6,971,916 B2 * 12/2005 Tokunaga ..... 439/607.09
7,462,040 B1 12/2008 Takada
7,553,187 B2 * 6/2009 Feldman et al. ..... 439/607.17
7,597,581 B2 10/2009 Trout et al.
7,837,479 B1 11/2010 Millard et al.
7,985,079 B1 7/2011 Wilson et al.
2005/0215120 A1 9/2005 Tokunaga
2005/0215121 A1 * 9/2005 Tokunaga ..... 439/608
2007/0066140 A1 * 3/2007 Matsuo et al. ..... 439/607
2013/0017721 A1 1/2013 Mason et al.
2013/0090025 A1 * 4/2013 Trout et al. ..... 439/884

FOREIGN PATENT DOCUMENTS

EP 1710873 A1 10/2006

OTHER PUBLICATIONS

International Search Report dated Jun. 5, 2015 received in International Application No. PCT/US2015/025334.

* cited by examiner

*Primary Examiner* — Tho D Ta

(57) ABSTRACT

A mezzanine receptacle connector includes a housing having a mating end mated with a mezzanine header connector and a mounting end mounted to a circuit board. Receptacle contacts are held by the housing having mating ends with deflectable spring beams and terminating ends for termination to the circuit board. A ground lattice is held by the housing that includes longitudinal receptacle ground shields extending longitudinally within the housing generally parallel to a longitudinal axis. The ground lattice includes lateral receptacle ground shields extending laterally within the housing generally perpendicular to the longitudinal axis. The longitudinal receptacle ground shields are mechanically and electrically connected to the lateral receptacle ground shields to form the ground lattice. The ground lattice provides electrical shielding for the receptacle contacts.

18 Claims, 7 Drawing Sheets

MEZZANINE RECEPTACLE CONNECTOR

BACKGROUND OF THE INVENTION

The subject matter herein relates generally to mezzanine receptacle connectors.

Known mezzanine connectors mechanically and electrically interconnect a pair of circuit boards in a parallel arrangement. Typically, the mezzanine connector will engage both circuit boards to interconnect the circuit boards. For example, the mezzanine connector will be mounted to one of the circuit boards and will engage the other circuit board at a separable mating interface. The mezzanine connector typically uses deflectable spring beams at the separable mating interface. However, such interfaces require a significant amount of real estate and space because the spring beams require long beam lengths to achieve the required spring force and deformation range. Contact density of such mezzanine connectors is limited because of the separable mating interface. At least some known mezzanine connector systems utilize two mezzanine connectors, each mounted to a different circuit board and then mated together. Such systems can be complex and difficult to manufacture. For example, such mezzanine connectors have many contacts individually loaded into a housing, which may be difficult and time consuming to assemble. Furthermore, known mezzanine connectors suffer from signal performance limits due to the tight spacing of the contacts in the mezzanine connectors.

Thus, a need exists for a mezzanine connector assembly that provides a cost effective and reliable connection between circuit boards.

BRIEF DESCRIPTION OF THE INVENTION

In one embodiment, a mezzanine receptacle connector is provided that includes a housing having a mating end configured to be mated with a mezzanine header connector and a mounting end configured to be mounted to a circuit board. The mating end is opposite the mounting end and the housing is elongated along a longitudinal axis. Receptacle contacts are held by the housing. The receptacle contacts have mating ends with deflectable spring beams for termination to corresponding header contacts of the mezzanine header connector. The receptacle contacts have terminating ends extending from the mounting end of the housing for termination to the circuit board. A ground lattice is held by the housing. The ground lattice includes longitudinal receptacle ground shields extending longitudinally within the housing generally parallel to the longitudinal axis, and the ground lattice includes lateral receptacle ground shields extending laterally within the housing generally perpendicular to the longitudinal axis. The longitudinal receptacle ground shields are mechanically and electrically connected to the lateral receptacle ground shields to form the ground lattice. The ground lattice provides electrical shielding for the receptacle contacts.

In another embodiment, a mezzanine receptacle connector is provided that includes a housing having a mating end configured to be mated with a mezzanine header connector and a mounting end configured to be mounted to a circuit board. The mating end is opposite the mounting end and the housing is elongated along a longitudinal axis. Receptacle contacts are held by the housing and are arranged in pairs carrying differential signals. The receptacle contacts have mating ends with deflectable spring beams for termination to corresponding header contacts of the mezzanine header connector. The receptacle contacts have terminating ends extending from the mounting end of the housing for termination to the circuit board. A ground lattice is held by the housing and provides electrical shielding for the pairs of receptacle contacts with each pair of receptacle contacts being electrically shielded from each other pair of receptacle contacts by the ground lattice. The ground lattice includes longitudinal receptacle ground shields extending longitudinally within the housing generally parallel to the longitudinal axis and aligned with associated receptacle contacts to provide electrical shielding therefore. The ground lattice includes lateral receptacle ground shields extending laterally within the housing generally perpendicular to the longitudinal axis and aligned with associated receptacle contacts to provide electrical shielding therefore. The longitudinal receptacle ground shields are mechanically and electrically connected to the lateral receptacle ground shields to form the ground lattice. Each longitudinal receptacle ground shield has a pair of deflectable spring beams extending from a planar base, with the pair of deflectable spring beams being generally longitudinally aligned with the deflectable spring beams of the associated receptacle contact. Each lateral receptacle ground shield has a pair of deflectable spring beams extending from a planar base, with the pair of deflectable spring beams of the lateral receptacle ground shield being spaced generally equidistant from the deflectable spring beams of the associated receptacle contact.

DETAILED DESCRIPTION OF THE INVENTION

Figure 1:
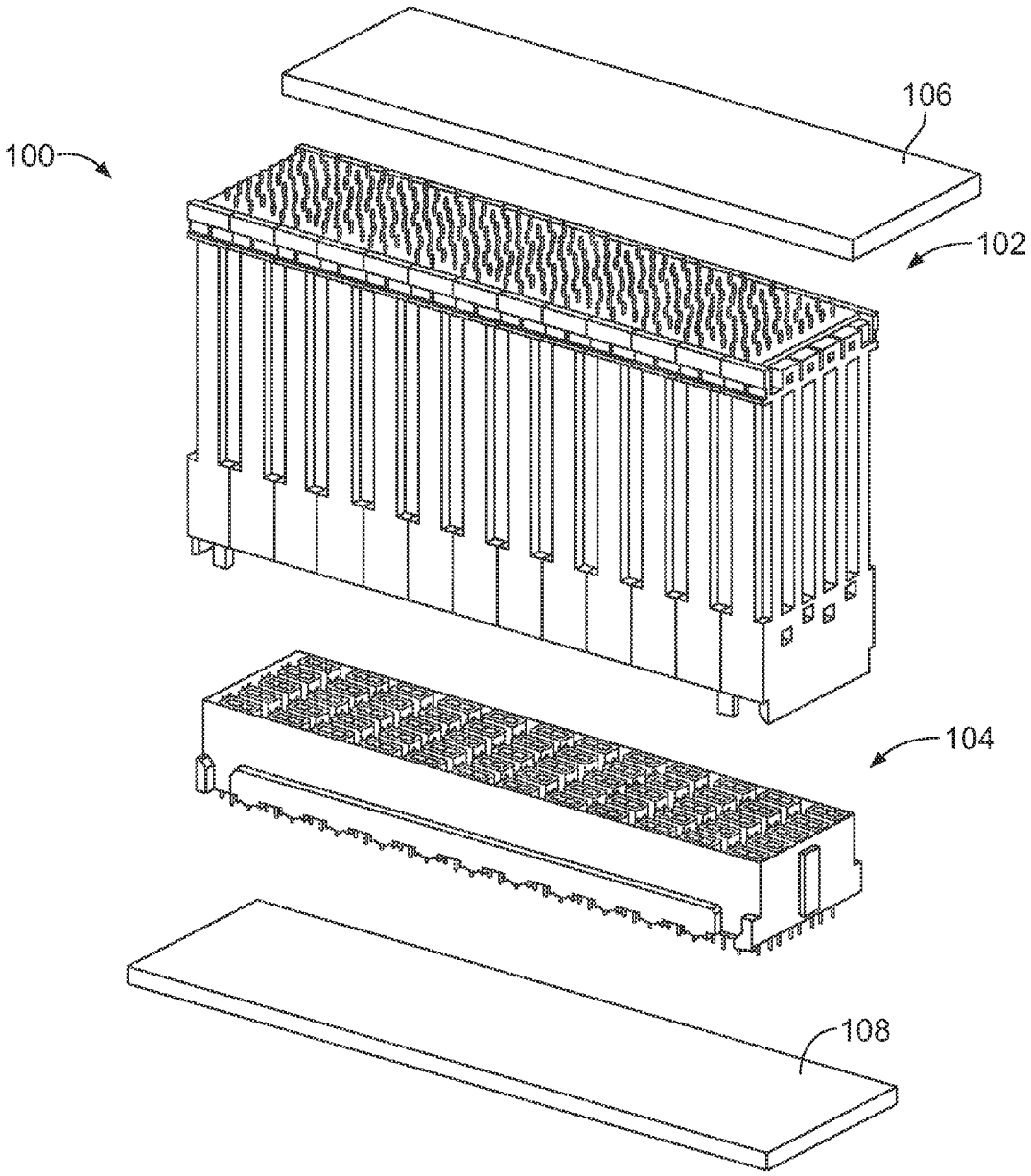
FIG. 1 illustrates a mezzanine connector assembly formed in accordance with an exemplary embodiment.

FIG. 1 illustrates a mezzanine connector assembly 100 formed in accordance with an exemplary embodiment. The mezzanine connector assembly 100 includes a mezzanine header connector 102 and a mezzanine receptacle connector 104 that are mated together to electrically connect first and second circuit boards 106, 108. The mezzanine header connector 102 and mezzanine receptacle connector 104 are arranged to interconnect the first and second circuit boards 106, 108 in a parallel arrangement. However, it is realized that the subject matter herein may be used in other types of electrical connectors as well, such as right angle connectors, cable connectors (being terminated to an end of one of more cables), or other types of electrical connectors.

The circuit boards 106, 108 are interconnected by the header and receptacle connectors 102, 104 so that the circuit boards 106, 108 are substantially parallel to one another. The first and second circuit boards 106, 108 include conductors that communicate data signals and/or electric power between the header and receptacle connectors 102, 104 and one or more electric components (not shown) that are electrically connected to the circuit boards 106, 108. The conductors may be embodied in electric pads or traces deposited on one or more layers of the circuit boards 106, 108, in plated vias, or in other conductive pathways, contacts, and the like.

Figure 2:
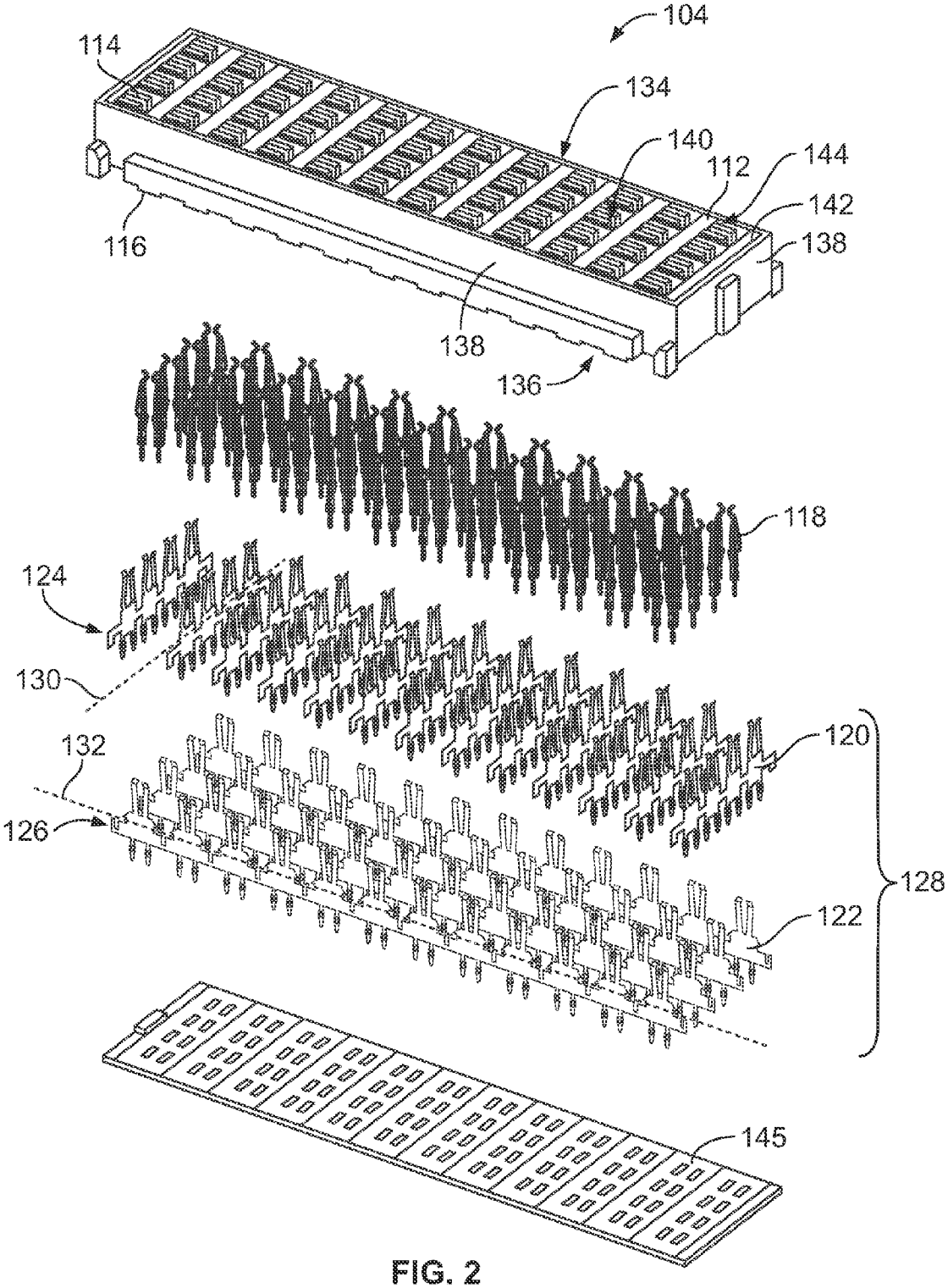
FIG. 2 is an exploded view of a mezzanine receptacle connector of the mezzanine connector assembly in accordance with an exemplary embodiment.

FIG. 2 is an exploded view of the mezzanine receptacle connector 104 in accordance with an exemplary embodiment. The mezzanine receptacle connector 104 includes a housing 112 extending between a front 114 and a rear 116 of the mezzanine receptacle connector 104. The front 114 is configured to be mated with the mezzanine header connector 102 (shown in FIG. 1). The rear 116 is configured to be mounted to the second circuit board 108 (shown in FIG. 1). The housing 112 holds a plurality of receptacle contacts 118 that extend between the front 114 and the rear 116. In an exemplary embodiment, the receptacle contacts 118 are arranged in pairs that carry differential signals. In alternative embodiments, the receptacle contacts 118 may carry single ended signals rather than differential signals. In other alternative embodiments, the receptacle contacts 118 may carry power rather than data signals. The receptacle contacts 118 may be loaded into the housing 112 through a rear of the housing 112.

The mezzanine receptacle connector 104 includes a plurality of lateral receptacle ground shields 120 and a plurality of longitudinal receptacle ground shields 122. In an exemplary embodiment, the lateral receptacle ground shields 120 are configured to be loaded into the housing 112 and extend laterally across the housing 112 parallel to a lateral axis 130 of the housing 112. The longitudinal receptacle ground shields 122 are configured to be loaded into the housing 112 and extend longitudinally across the housing 112 parallel to a longitudinal axis 132 of the housing 112.

The receptacle ground shields 120, 122 may be inserted into the housing 112 through the rear of the housing 112 such that the receptacle ground shields 120, 122 provide electrical shielding for the receptacle contacts 118, such as for each pair of receptacle contacts 118. The receptacle ground shields 120, 122 may be electrically connected to one or more conductive, grounded surfaces of the mezzanine header connector 102 and/or the circuit board 108.

A plurality of the lateral receptacle ground shields 120 are arranged together as part of a common lateral receptacle ground shield strip 124. The lateral receptacle ground shield strip 124 may include any number of the lateral receptacle ground shields 120. A plurality of the longitudinal receptacle ground shields 122 are arranged together as part of a common longitudinal receptacle ground shield strip 126. The longitudinal receptacle ground shield strip 126 may include any number of the longitudinal receptacle ground shields 122. In an exemplary embodiment, the receptacle ground shield strips 124, 126 are interconnected to define a ground lattice 128 to provide shielding around multiple sides of each pair of receptacle contacts 118. For example, each of the lateral receptacle ground shield strips 124 are mechanically and electrically connected to each of the longitudinal receptacle ground shield strip 126. The receptacle ground shield strips 124, 126 may be clipped together or press fit into each other. The lateral receptacle ground shields 120 may provide shielding between rows of receptacle contacts 118 and the longitudinal receptacle ground shields 122 may provide shielding between columns of receptacle contacts 118, as explained in further detail below.

The housing 112 is manufactured from a dielectric material, such as a plastic material. The housing 112 has a mating end 134 and a mounting end 136 opposite the mating end 134. The housing 112 includes sides 138 that define a perimeter of the housing 112 between the mating and mounting ends 134, 136. Optionally, the housing 112 may be generally box shaped, however the housing 112 may have any shape in alternative embodiments.

In an exemplary embodiment, the housing 112 includes receptacle contact openings 140 extending between the mating and mounting ends 134, 136 that receive corresponding receptacle contacts 118. The housing 112 includes lateral receptacle ground shield openings 142 extending between the mating and mounting ends 134, 136 that receive corresponding lateral receptacle ground shields 120 and longitudinal receptacle ground shield openings 144 extending between the mating and mounting ends 134, 136 that receive corresponding longitudinal receptacle ground shields 122.

In an exemplary embodiment, the mezzanine receptacle connector 104 includes a pin organizer 145. The pin organizer 145 is configured to be coupled to the rear 116 of the mezzanine receptacle connector 104. The pin organizer 145 includes a plurality of openings therethrough that receive corresponding pins of the receptacle contacts 118 and/or the receptacle ground shields 120, 122. The pin organizer 145 holds the relative positions of the receptacle contacts 118 and/or receptacle ground shields 120, 122 for mounting to the second circuit board 108 (shown in FIG. 1). The pin organizer 145 may protect the pins of the receptacle contacts 118 and/or the receptacle ground shields 120, 122 from damage, such as during shipping, assembly, and/or mounting to the second circuit board 108.

Figure 3:
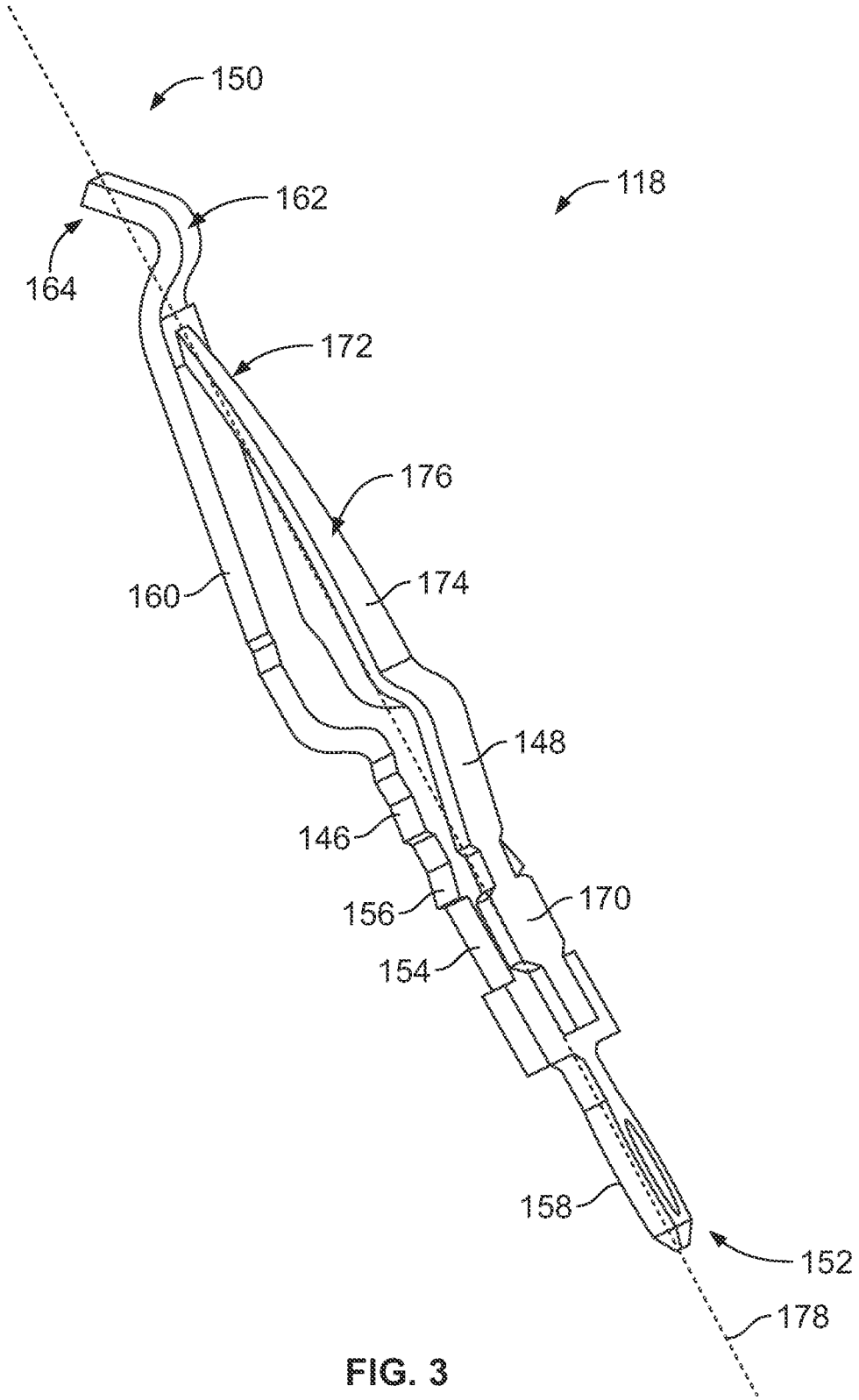
FIG. 3 illustrates a receptacle contact of the mezzanine receptacle connector formed in accordance with an exemplary embodiment.

FIG. 3 illustrates one of the receptacle contacts 118 formed in accordance with an exemplary embodiment. The receptacle contact 118 includes a main contact 146 and a sub-contact 148 extending from the main contact 146. Optionally, the sub-contact 148 may be discrete from the main contact 146 and fixed thereto by a fixing process, such as welding, soldering, crimping, fastening, adhering, and the like. Alternatively, the sub-contact 148 may be integral with the main contact 146, such as both being stamped from a common blank and then formed to position the sub-contact 148 relative to the main contact 146. The main contact 146 and the sub-contact 148 both define points of contact with a corresponding header contact 212 (shown in FIG. 6) of the mezzanine header connector 102 (shown in FIG. 1).

The main contact 146 of the receptacle contact 118 extends between a mating end 150 and a terminating end 152. The main contact 146 of the receptacle contact 118 includes a base 154 between the mating end 150 and the terminating end 152. The base 154 includes barbs 156 along sides thereof for securing the receptacle contact 118 in the housing 112 (shown in FIG. 2).

The receptacle contact 118 includes a compliant pin 158 extending from the base 154 at the terminating end 152. The compliant pin 158 is configured to be terminated to the circuit board 108 (shown in FIG. 1). Types of interfaces other than a compliant pin, such as a solder pin, a solder tail, a spring beam, and the like, may be provided at the terminating end 152 in alternative embodiments.

The receptacle contact 118 includes a spring beam 160 at the mating end 150. The spring beam 160 is deflectable and is configured to be mated with a corresponding contact of the mezzanine header connector 102 (shown in FIG. 1). The spring beam 160 includes a curved mating interface 162 proximate to a distal end 164 of the spring beam 160. The mating interface 162 is configured engage the corresponding header contact 212 (shown in FIG. 4) of the mezzanine header connector 102. The spring beam 160 may be elastically deformed when mated to the header contact 212 and press against the header contact 212 to maintain an electrical connection therewith. Optionally, the distal end 164 may be hook shaped and define a hook, which may be referred to hereinafter as a hook 164.

The sub-contact 148 of the receptacle contact 118 extends between a base end 170 and a support end 172. The base end 170 extends from the base 154. In an exemplary embodiment, the base end 170 is welded to the base 154. Alternatively, the base end 170 may be secured by other methods, such as being soldered, crimped, fastened or otherwise fixed to the base 154. In other alternative embodiments, the base end 170 may be integral with the base 154, such as being stamped from a common blank.

The sub-contact 148 includes a support beam 174 at the support end 172. The support beam 174 includes a mating interface 176 that is engaged by the header contact 212 (shown in FIG. 4). For example, the support beam 174 of the sub-contact 148 is configured to be directly electrically connected to the header contact 212 to define a second point of contact with the header contact 212 of the mezzanine header connector 102 (shown in FIG. 1).

In an exemplary embodiment, the distal end of the support beam 174 engages the spring beam 160, such as proximate to the mating interface 162. As such, the sub-contact 148 has multiple points of contact with the main contact 146, such as at the base end 170 and the support end 172. The support beam 174 engages the spring beam 160 remote from the base 154. The support beam 174 may support the spring beam 160. The support beam 174 may be deflected with the spring beam 160 when mated with the header contact 212. In an exemplary embodiment, the support beam 174 is a simply supported beam, which is supported at opposite ends by the base 154 and the spring beam 160, rather than a cantilevered beam. The support beam 174 is relatively stiff because the support beam 174 is supported at both ends, and thus may be manufactured from a thinner stock of material to reduce the overall cost of the receptacle contact 118. The mating interface 176 may be approximately centered between the base end 170 and the support end 172.

In an exemplary embodiment, the main contact 146 is thicker than the sub-contact 148. For example, the sub-contact 148 is stamped and formed from a stock or blank that is thinner than the stock or blank used to manufacture the main contact 146. The main contact 146 may thus be stiffer than the sub-contact 148.

The receptacle contact 118 extends generally along a contact axis 178. Optionally, the receptacle contact 118 may be oriented such that the contact axis 178 is oriented vertically. The mating interfaces 162, 176 are offset along the contact axis 178. For example, the mating interface 162 of the main contact 146 is positioned vertically above the mating interface 176 of the sub-contact 148. The header contact 212 (shown in FIG. 4) may be mated with the receptacle contact 118 along the contact axis 178 such that the header contact 212 engages the main contact 146 before engaging the sub-contact 148. Optionally, the main contact 146 and the sub-contact 148 may be selectively plated, such as at the mating interfaces 162, 176, respectively. In an exemplary embodiment, the spring beam 160 is bowed or bent outward in a first direction from the base 154, while the support beam 174 is bowed or bent outward in a second direction, generally opposite the first direction, from the base 154.

Figure 4:
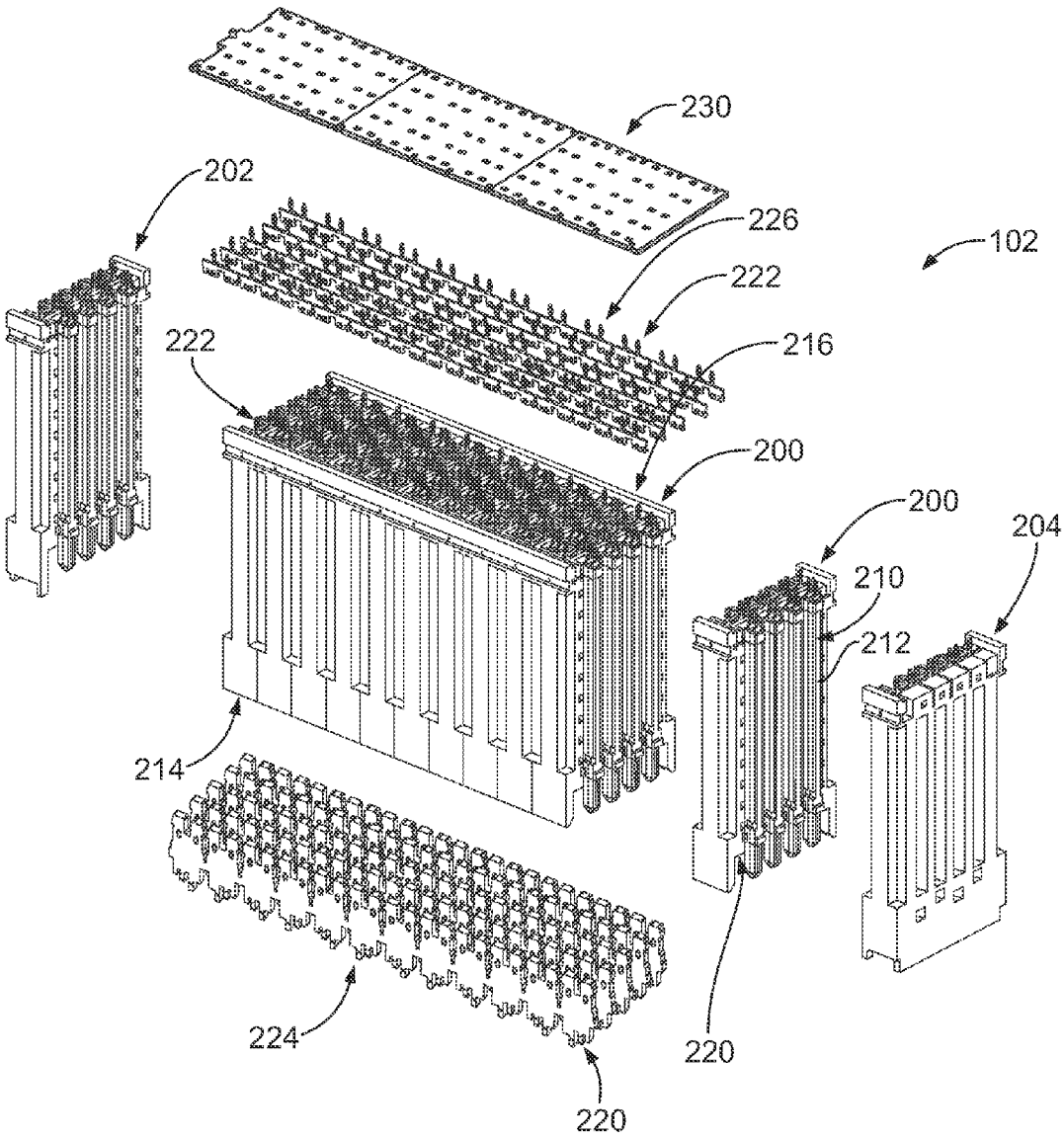
FIG. 4 is an exploded view of a mezzanine header connector of the mezzanine connector assembly in accordance with an exemplary embodiment.

FIG. 4 is an exploded view of the mezzanine header connector 102 in accordance with an exemplary embodiment. The mezzanine header connector 102 includes a plurality of header modules 200, 202, 204. The header modules 200 define middle header modules, which are flanked on opposite sides by the end header modules 202, 204. Any number of middle header modules 200 may be provided depending on the particular application. The end header modules 202, 204 may be identical to one another, or alternatively may be different from one another.

The header modules 200, 202, 204 hold contact assemblies 210, each having a plurality of header contacts 212. The header contacts 212 are configured to be mated with corresponding receptacle contacts 118 (shown in FIG. 2). The header modules 200, 202, 204 are stacked adjacent each other in abutting contact with each other to provide electrical shielding for the header contacts 212. In an exemplary embodiment, the header contacts 212 are arranged in pairs that carry differential signals. The header modules 200, 202, 204 surround the individual pairs of header contacts 212 and provide electrical shielding around each of the pairs of header contacts 212. In alternative embodiments, the header contacts 212 may carry single ended signals rather than differential signals. In other alternative embodiments, the header contacts 212 may carry power rather than data signals.

The header contacts 212 extend between a front 214 of the mezzanine header connector 102 and a rear 216 of the mezzanine header connector 102. The front 214 is configured to be mated with the mezzanine receptacle connector 104 (shown in FIG. 1). The rear 216 is configured to be mounted to the first circuit board 106 (shown in FIG. 1). In an exemplary embodiment, the header modules 200, 202, 204 provide electrical shielding for the header contacts 212 along substantially the entire length of the header contacts 212 between the front 214 and the rear 216.

The mezzanine header connector 102 includes a plurality of front header ground shields 220 at the front 214 and a plurality of rear header ground shields 222 at the rear 216. The header ground shields 220, 222 may be inserted into the header modules 200, 202, 204 such that the header ground shields 220, 222 provide electrical shielding for the header contacts 212. The header ground shields 220, 222 may be electrically connected to one or more conductive surfaces of the header modules 200, 202, 204. The header ground shields 220, 222 are configured to be electrically connected to the mezzanine receptacle connector 104 and the first circuit board 106, respectively.

In an exemplary embodiment, the front header ground shields 220 define a front ground lattice 224 to provide shielding around multiple sides of each pair of header contacts 212. For example, the front header ground shields 220 may include both longitudinal components and lateral components that provide shielding between rows and columns of the header contacts 212. The front header ground shields 220 are configured to be mated with corresponding receptacle ground shields 120, 122 (shown in FIG. 2). The rear header ground shields 222 define a rear ground lattice 226 to provide shielding around multiple sides of each pair of header contacts 212. For example, the rear header ground shields 222 may include both longitudinal components and lateral components that provide shielding between rows and columns of the header contacts 212.

In an exemplary embodiment, the mezzanine header connector 102 includes a pin organizer 230. The pin organizer 230 is configured to be coupled to the rear 216 of the mezzanine header connector 102. The pin organizer 230 includes a plurality of openings therethrough that receive corresponding pins of the header contacts 212 and/or the rear header ground shields 222. The pin organizer 230 holds the relative positions of the header contacts 212 and/or rear header ground shields 222 for mounting to the first circuit board 106. The pin organizer 230 may protect the pins of the header contacts 212 and/or the rear header ground shields 222 from damage, such as during shipping, assembly, and/or mounting to the first circuit board 106.

Figure 5:
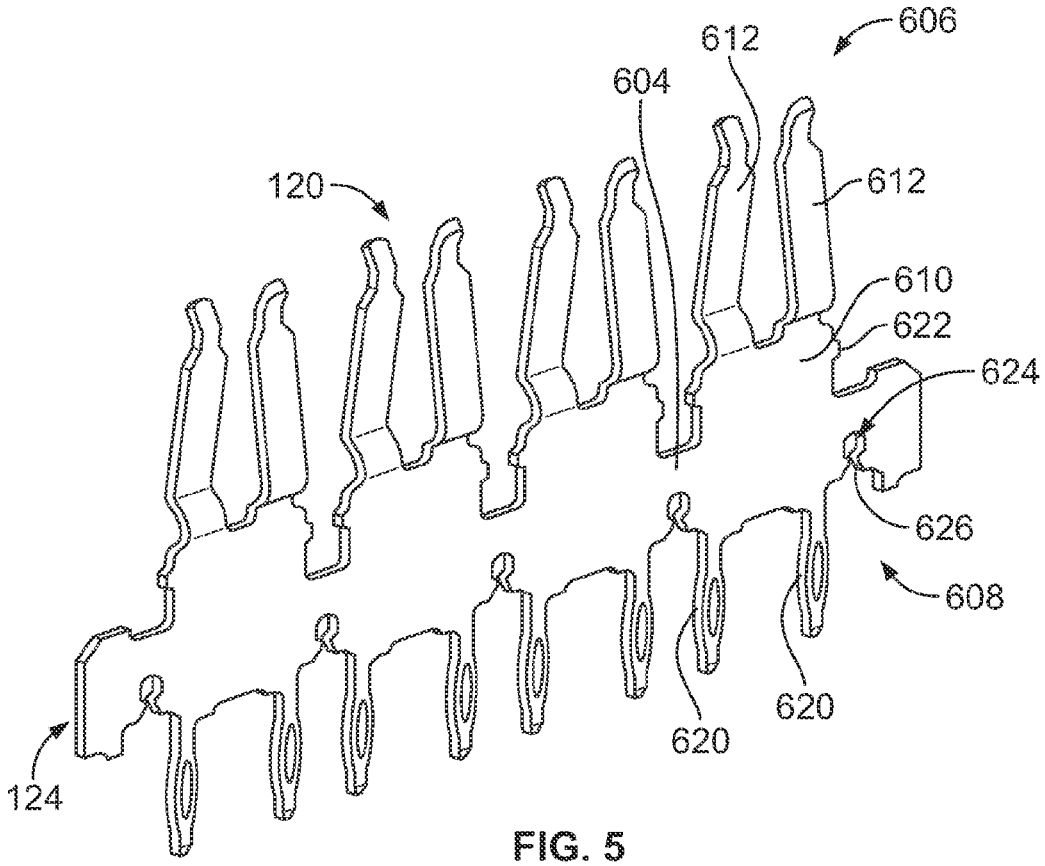
FIG. 5 illustrates a lateral receptacle ground shield strip of the mezzanine receptacle connector in accordance with an exemplary embodiment.

FIG. 5 illustrates one of the lateral receptacle ground shield strips 124 including a plurality of the lateral receptacle ground shields 120 in accordance with an exemplary embodiment. The lateral receptacle ground shield strip 124 may include any number of the lateral receptacle ground shields 120, which may correspond to the number of pairs of receptacle contacts 118 (shown in FIG. 2) in each row in the housing 112 (shown in FIG. 2). The lateral receptacle ground shield strip 124 includes bridges 604 extending between adjacent lateral receptacle ground shields 120. The bridges 604 may be part(s) of one or more lateral receptacle ground shields 120. The widths of the bridges 604 control the lateral spacing of the lateral receptacle ground shields 120. The lateral receptacle ground shields 120 each include a mating end 606 and a mounting end 608 opposite the mating end 606. The mating end 606 is configured to be mechanically and electrically coupled to a corresponding header ground shield 220 (shown in FIG. 4) of the mezzanine header connector 102 (shown in FIG. 4). The mounting end 608 is configured to be mechanically and electrically connected to the circuit board 108 (shown in FIG. 1).

In the illustrated embodiment, the lateral receptacle ground shields 120 each include a base 610 that is generally planar. The base 610 is configured to be plugged into the housing 112 (shown in FIG. 2) during assembly of the mezzanine receptacle connector 104. In an exemplary embodiment, the lateral receptacle ground shields 120 include spring beams 612 extending from corresponding bases 610. The spring beams 612 are deflectable and are configured to interface with corresponding header ground shields 220 (shown in FIG. 4). In an exemplary embodiment, the spring beams 612 are bent and angled out of the plane of the base 610. The spring beams 612 have curved tips that may be used to guide mating with the header ground shields 220. Optionally, each base 610 may include a pair of spring beams 612. Optionally, the pair of spring beams 612 may be angled in respective opposite directions, which may balance mating forces during mating. The pair of spring beams 612 may engage respective different sides of the header ground shields 220, which may balance mating forces during mating. Optionally, the spring beams 612 may have respective different lengths such that the tips of the spring beams 612 are at different distances from the base 610. Having different length spring beams 612 staggers the mating interfaces of the spring beams 612 with the receptacle ground shields, which reduces the mating force for mating the mezzanine receptacle connector 104 with the mezzanine header connector 102.

The mounting end 608 includes compliant pins 620 extending from corresponding bases 610. The compliant pins 620 may be eye-of-the-needle pins. The compliant pins 620 may be received in plated vias in the circuit board 108 (shown in FIG. 1) to mechanically and electrically couple the lateral receptacle ground shield strip 124 to the circuit board 108. Optionally, each base 610 may include multiple compliant pins 620.

The base 610 includes projections 622 extending from the sides of the base 610. The projections 622 may dig into the housing 112 (shown in FIG. 2) to hold the lateral receptacle ground shield 120 in the housing 112 by an interference fit. The base 610 may include interference bumps (not shown) configured to engage the housing 112 to hold the lateral receptacle ground shield 120 in the housing 112 by an interference fit.

The lateral receptacle ground shield strip 124 includes channels 624 defined between adjacent lateral receptacle ground shields 120. The channels 624 may be formed in or by one or more lateral receptacle ground shields 120. The lateral receptacle ground shields 120 have tabs 626 extending into the channels 624. The channels 624 are configured to receive corresponding longitudinal receptacle ground shield strips 126 (shown in FIG. 2) and the tabs 626 mechanically and electrically engage the corresponding longitudinal receptacle ground shield strips 126.

Figure 6:
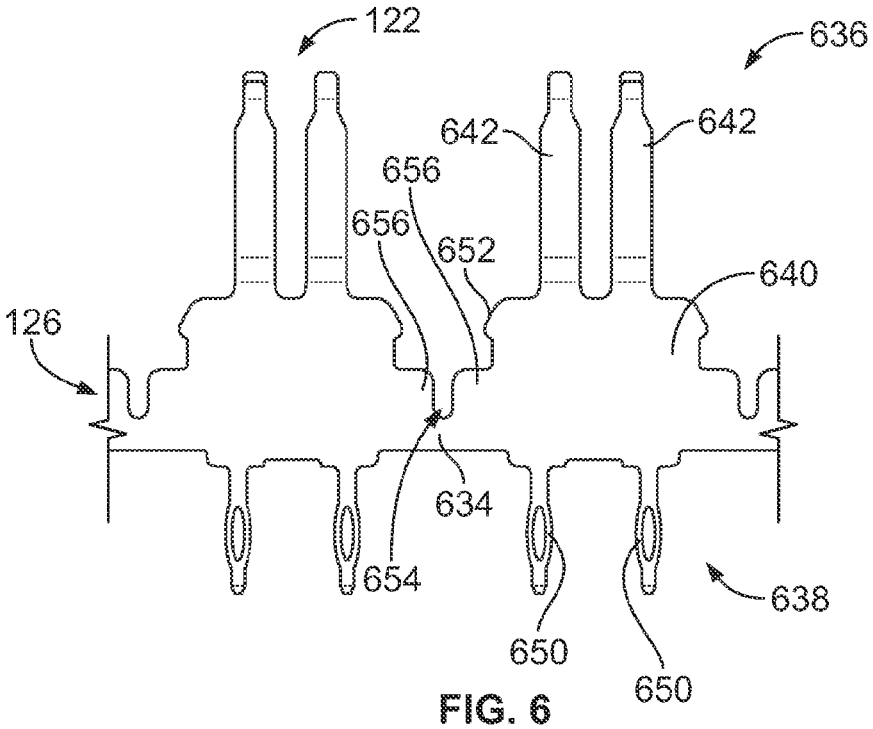
FIG. 6 illustrates a portion of a longitudinal receptacle ground shield strip of the mezzanine receptacle connector in accordance with an exemplary embodiment.

FIG. 6 illustrates a portion of one of the longitudinal receptacle ground shield strips 126 including a plurality of the longitudinal receptacle ground shields 122 in accordance with an exemplary embodiment. The longitudinal receptacle ground shield strip 126 may include any number of the longitudinal receptacle ground shields 122, which may correspond to the number of pairs of receptacle contacts 118 (shown in FIG. 2) in each column in the housing 112 (shown in FIG. 2). The longitudinal receptacle ground shield strip 126 includes bridges 634 extending between adjacent longitudinal receptacle ground shields 122. The bridges 634 may be part(s) of one or more longitudinal receptacle ground shields 122. The widths of the bridges 634 control the longitudinal spacing of the longitudinal receptacle ground shields 122. The longitudinal receptacle ground shields 122 each include a mating end 636 and a mounting end 638 opposite the mating end 636. The mating end 636 is configured to be mechanically and electrically coupled to a corresponding header ground shield 220 (shown in FIG. 4) of the mezzanine header connector 102 (shown in FIG. 4). The mounting end 638 is configured to be mechanically and electrically connected to the circuit board 108 (shown in FIG. 1).

In the illustrated embodiment, the longitudinal receptacle ground shields 122 each include a base 640 that is generally planar. The base 640 is configured to be plugged into the housing 112 during assembly of the mezzanine receptacle connector 104 (shown in FIG. 2). In an exemplary embodiment, the longitudinal receptacle ground shields 122 include spring beams 642 extending from corresponding bases 640. The spring beams 642 are deflectable and are configured to interface with corresponding header ground shields 220 (shown in FIG. 4). In an exemplary embodiment, the spring beams 642 are bent and angled out of the plane of the base 640 in a similar manner as the spring beams 612 (shown in FIG. 5). The spring beams 642 have curved tips that may be used to guide mating with the header ground shields 220. Optionally, each base 640 may include a pair of spring beams 642. Optionally, the pair of spring beams 642 may be angled in respective opposite directions, which may balance mating forces during mating. The pair of spring beams 642 may engage respective different sides of the header ground shields 220, which may balance mating forces during mating. Optionally, the spring beams 642 may have respective different lengths such that the tips of the spring beams 642 are at different distances from the base 640. Having different length spring beams 642 staggers the mating interfaces of the spring beams 642 with the receptacle ground shields, which reduces the mating force for mating the mezzanine receptacle connector 104 with the mezzanine header connector 102.

The mounting end 638 includes compliant pins 650 extending from corresponding bases 640. The compliant pins 650 may be eye-of-the-needle pins. The compliant pins 650 may be received in plated vias in the circuit board 108 (shown in FIG. 1) to mechanically and electrically couple the longitudinal receptacle ground shield strip 126 to the circuit board 108. Optionally, each base 640 may include multiple compliant pins 650.

The base 640 includes projections 652 extending from the sides of the base 640. The projections 652 may dig into the housing 112 (shown in FIG. 2) to hold the longitudinal receptacle ground shield 122 in the housing 112 by an interference fit. The base 640 may include interference bumps (not shown) configured to engage the housing 112 to hold the longitudinal receptacle ground shield 122 in the housing 112 by an interference fit.

The longitudinal receptacle ground shield strip 126 includes channels 654 defined between adjacent longitudinal receptacle ground shields 122. The longitudinal receptacle ground shields 122 have tabs 656 flanking the channels 654. The channels 654 may be formed in or by one or more longitudinal receptacle ground shields 122. The channels 654 are configured to receive corresponding bridges 604 (shown in FIG. 5) of the lateral receptacle ground shield strips 124 (shown in FIG. 2) and the bridges 634 mechanically and electrically engage the corresponding lateral receptacle ground shield strips 124.

Figure 7:
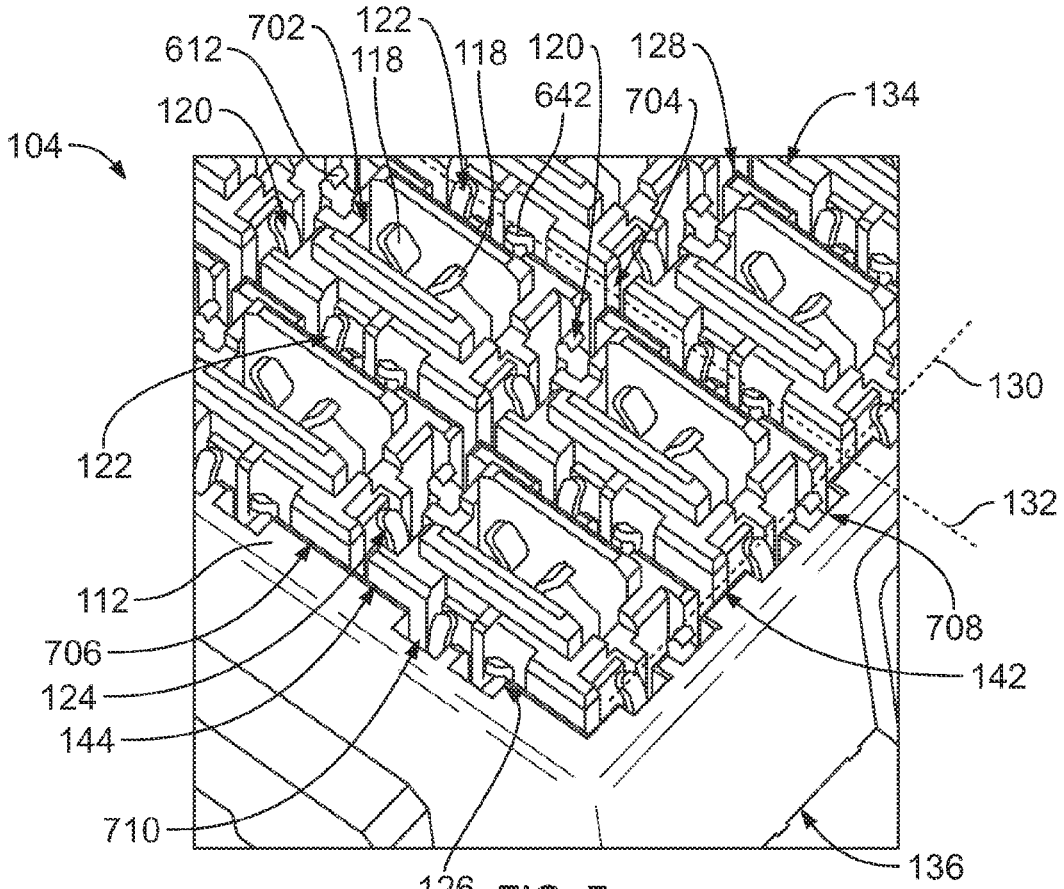
FIG. 7 is a front perspective view of the mezzanine receptacle connector.
Figure 8:
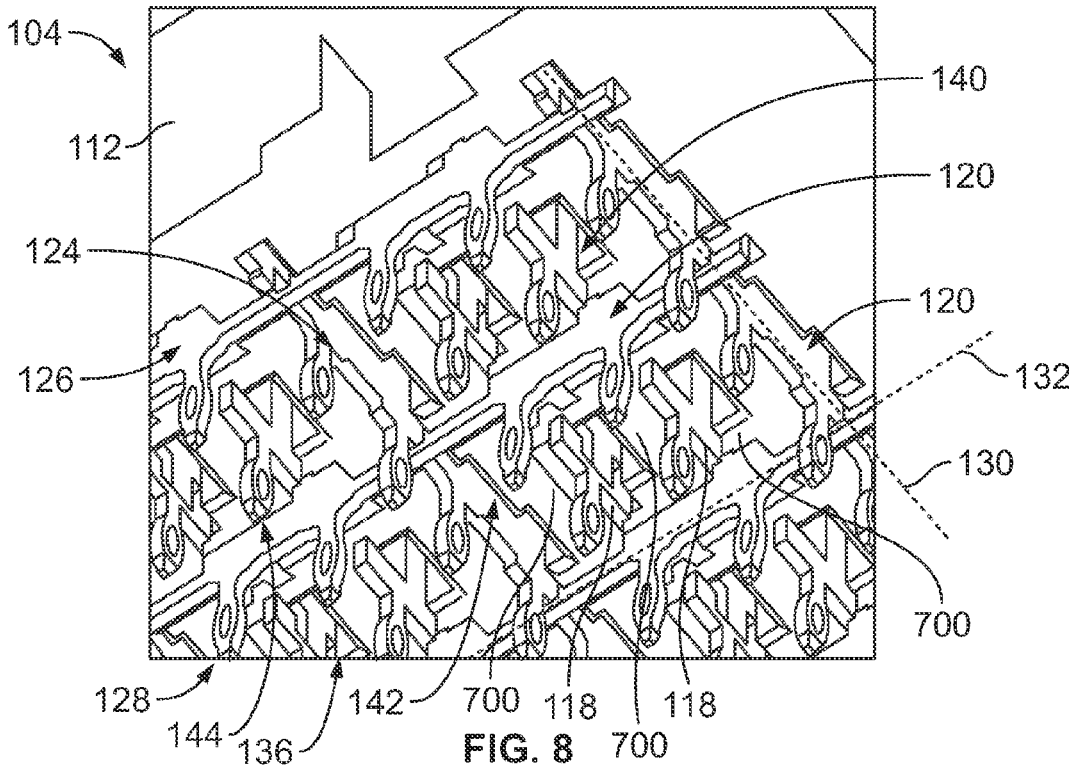
FIG. 8 is a rear perspective view of the mezzanine receptacle connector.

FIG. 7 is a front perspective view of the mezzanine receptacle connector 104 showing the lateral and longitudinal receptacle ground shield strips 124, 126 loaded into the housing 112. FIG. 8 is a rear perspective view of the mezzanine receptacle connector 104 showing the lateral and longitudinal receptacle ground shield strips 124, 126 loaded into the housing 112. FIGS. 7 and 8 illustrate the receptacle contacts 118 arranged in pairs in the housing 112 and surrounded by the ground lattice 128.

The receptacle contacts 118 are shown loaded in the receptacle contact openings 140 (FIG. 8) in the housing 112 and are arranged as pairs. At the mounting end 136 (FIG. 8), the receptacle contact openings 140 are discrete openings or pockets with separating walls 700 defining the receptacle contact openings 140. The receptacle contacts 118 may be held in the receptacle contact openings 140 by an interference fit with the separating walls 700. At the mating end 134 (FIG. 7), the receptacle contact openings 140 holding pairs of the receptacle contacts 118 are open to each other in a single pocket, which may be referred to hereinafter as a contact cavity 702. Both receptacle contacts 118 of each pair are exposed within the contact cavity 702 for mating with the corresponding pair of header contacts 212 (shown in FIG. 4). The contact cavity 702 receives a portion of the corresponding contact assembly 210 (shown in FIG. 4) therein, such as between the receptacle contacts 118.

The lateral receptacle ground shields 120 and longitudinal receptacle ground shields 122 are shown loaded in the lateral receptacle ground shield openings 142 and longitudinal receptacle ground shield openings 144, respectively. The lateral receptacle ground shield openings 142 and longitudinal receptacle ground shield openings 144 include lateral slots 704 and longitudinal slots 706, respectively. The elongated slots 704, 706 allow the receptacle ground shield strips 124, 126 to be loaded into the housing 112. The slots 704, 706 may receive portions of the header ground shields 220 (shown in FIG. 4) during mating of the mezzanine header connector 102 (shown in FIG. 2) and the mezzanine receptacle connector 104.

In an exemplary embodiment, the lateral receptacle ground shield openings 142 include pockets 708 at the mating end 134 that receive corresponding spring beams 612 of the lateral receptacle ground shields 120. The pockets 708 may be sized to allow the spring beams 612 to deflect, such as during mating with the corresponding header ground shield 220. The pockets 708 may receive portions of the header ground shields 220 during mating of the mezzanine header connector 102 and the mezzanine receptacle connector 104.

In an exemplary embodiment, the longitudinal receptacle ground shield openings 144 include pockets 710 at the mating end 134 that receive corresponding spring beams 642 of the longitudinal receptacle ground shields 122. The pockets 710 may be sized to allow the spring beams 642 to deflect, such as during mating with the corresponding header ground shield 220. The pockets 710 may receive portions of the header ground shields 220 during mating of the mezzanine header connector 102 and the mezzanine receptacle connector 104.

The lateral receptacle ground shield strips 124 extend laterally in the housing 112 parallel to the lateral axis 130 of the mezzanine receptacle connector 104. The lateral receptacle ground shields 120 are generally centered between rows of pairs of receptacle contacts 118. The longitudinal receptacle ground shield strips 126 extend longitudinally in the housing 112 parallel to the longitudinal axis 132 of the mezzanine receptacle connector 104. The longitudinal receptacle ground shields 122 are positioned between columns of the receptacle contacts 118.

The longitudinal receptacle ground shield strips 126 are mechanically and electrically connected to each of the lateral receptacle ground shield strips 124. Similarly, the lateral receptacle ground shield strips 124 are mechanically and electrically connected to each of the longitudinal receptacle ground shield strips 126. The mechanical and electrical interconnection of the lateral receptacle ground shield strips 124 and the longitudinal receptacle ground shield strips 126 forms the ground lattice 128.

Figure 9:
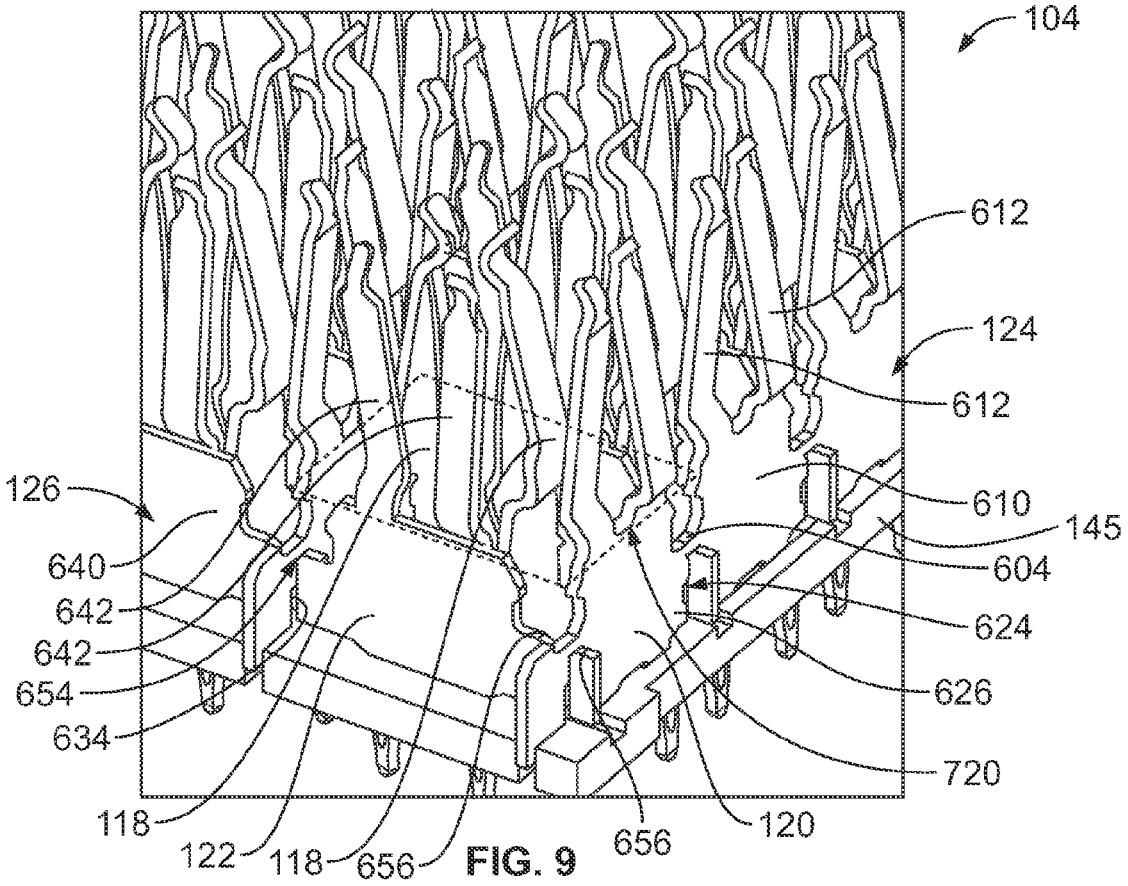
FIG. 9 illustrates a portion of the mezzanine receptacle connector with a housing thereof removed to illustrate the receptacle contacts and receptacle ground shields.

FIG. 9 illustrates a portion of the mezzanine receptacle connector 104 with the housing 112 (shown in FIGS. 7 and 8) removed to illustrate the receptacle contacts 118 and the receptacle ground shields 120, 122 held by the organizer 145. During assembly, when the longitudinal receptacle ground shield strips 126 are loaded into the housing 112, the channels 654 receive portions of the lateral receptacle ground shield strips 124. For example, the bridges 604 may be received in corresponding channels 654. The tabs 656 engage the bridges 604 to create a mechanical and electrical connection between the longitudinal receptacle ground shield strips 126 and the lateral receptacle ground shield strips 124. Similarly, the channels 624 receive portions of the longitudinal receptacle ground shield strips 126. For example, the bridges 634 may be received in corresponding channels 624. The tabs 626 engage the bridges 634 to create a mechanical and electrical connection between the longitudinal receptacle ground shield strips 126 and the lateral receptacle ground shield strips 124.

The bases 610, 640 and spring beams 612, 642 of the receptacle ground shields 120, 122, respectively, form shield boxes 720 around corresponding pairs of receptacle contacts 118. The shield boxes 720 provide 360° electrical shielding around the perimeter of each pair of receptacle contacts 118. The receptacle ground shields 120, 122 may cooperate with the header ground shields 220 to ensure that the receptacle contact 118 and header contacts 212 (shown in FIG. 4) are electrically shielded at the mating interfaces therebetween.

Figure 10:
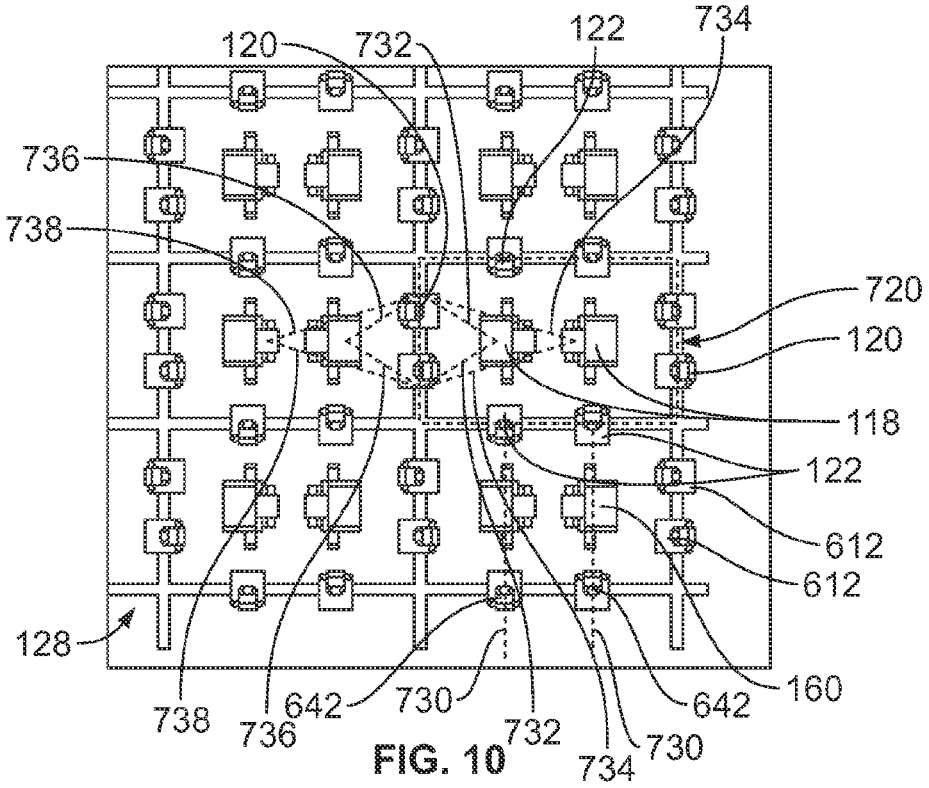
FIG. 10 is a front view of a ground lattice of the mezzanine receptacle connector.

FIG. 10 is a front view of the ground lattice 128 showing the shield boxes 720 formed by the receptacle ground shields 120, 122 surrounding each of the pairs of receptacle contacts 118. Each pair of receptacle contacts 118 is electrically shielded from each other pair of receptacle contacts 118. The shield boxes 720 each have pair of longitudinal receptacle ground shields 122 on respective opposite sides of the receptacle contacts 118 and a pair of lateral receptacle ground shields 120 on respective opposite sides of the receptacle contacts 118 to form a generally rectangular box around the receptacle contacts 118. The shield boxes 720 may have other shapes and may have other ground shields forming part of the shield boxes 720 in alternative embodiments.

In the illustrated embodiment, each longitudinal receptacle ground shield 122 has a pair of the deflectable spring beams 642. The pair of deflectable spring beams 642 are generally longitudinally aligned with the spring beams of the associated receptacle contacts 118, which is illustrated by lines 730 showing the spring beams 642 longitudinally aligned with associated spring beams 160 of the receptacle contacts 118. The spring beams 642 provide electrical shielding along the receptacle contacts 118. In the illustrated embodiment, each lateral receptacle ground shield 120 has a pair of the deflectable spring beams 612. Each deflectable spring beam 612 is spaced generally equidistant from the deflectable spring beams 160 of the associated receptacle contacts 118 within the shield boxes 720, which is illustrated by lines 732, 734, 736, 738 showing the distance between the spring beams 642 and the associated receptacle contacts 118.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A mezzanine receptacle connector comprising:

a housing having a mating end configured to be mated with a mezzanine header connector and a mounting end configured to be mounted to a circuit board, the mating end being opposite the mounting end, the housing being elongated along a longitudinal axis;

receptacle contacts held by the housing, the receptacle contacts having mating ends with deflectable spring beams for termination to corresponding header contacts of the mezzanine header connector, the receptacle contacts having terminating ends extending from the mounting end of the housing for termination to the circuit board; and a ground lattice held by the housing, the ground lattice comprising longitudinal receptacle ground shields extending longitudinally within the housing generally parallel to the longitudinal axis, and the ground lattice comprising lateral receptacle ground shields extending laterally within the housing generally perpendicular to the longitudinal axis, the longitudinal receptacle ground shields being mechanically and electrically connected to the lateral receptacle ground shields to form the ground lattice, the ground lattice providing electrical shielding for the receptacle contacts;

wherein the receptacle contacts are arranged in pairs carrying differential signals, the ground lattice providing electrical shielding for each pair of receptacle contacts from each other pair of receptacle contacts; and wherein each longitudinal receptacle ground shield includes a pair of deflectable spring beams extending from a planar base, the pair of deflectable spring beams being generally longitudinally aligned with the deflectable spring beams of the associated pair of receptacle contacts, each lateral receptacle ground shield having a planar base and at least one deflectable spring beam.

2. The mezzanine receptacle connector of claim 1, wherein the longitudinal receptacle ground shields include tabs engaging corresponding lateral receptacle ground shields to electrically connect the longitudinal receptacle ground shields with the lateral receptacle ground shields.

3. The mezzanine receptacle connector of claim 1, wherein the lateral receptacle ground shields include tabs engaging corresponding longitudinal receptacle ground shields to electrically connect the lateral receptacle ground shields with the longitudinal receptacle ground shields.

4. The mezzanine receptacle connector of claim 1, wherein each lateral receptacle ground shield has a pair of deflectable spring beams extending from each planar base, the pair of deflectable spring beams of the lateral receptacle ground shield being spaced generally equidistant from each of the deflectable spring beams of the associated pair of receptacle contacts.

5. The mezzanine receptacle connector of claim 1, wherein a plurality of the longitudinal receptacle ground shields are connected by bridges to form a longitudinal receptacle ground shield strip, the housing holding a plurality of longitudinal receptacle ground shield strips.

6. The mezzanine receptacle of connector claim 5, wherein the longitudinal receptacle ground shield strip includes channels aligned with the bridges between adjacent longitudinal receptacle ground shields, the channels receiving lateral receptacle ground shields.

7. The mezzanine receptacle connector of claim 1, wherein a plurality of the lateral receptacle ground shields are connected by bridges to form a lateral receptacle ground shield strip, the housing holding a plurality of lateral receptacle ground shield strips.

8. The mezzanine receptacle connector of claim 7, wherein the lateral receptacle ground shield strips include channels aligned with the bridges between adjacent lateral receptacle ground shields, the channels receiving longitudinal receptacle ground shields.

9. The mezzanine receptacle connector of claim 1, wherein the ground lattice forms shield boxes with a pair of longitudinal receptacle ground shields on respective opposites sides of the corresponding shield box and with a pair of lateral receptacle ground shields on respective opposite sides of the corresponding shield box.

10. The mezzanine receptacle connector of claim 9, wherein the receptacle contacts are arranged in pairs carrying differential signals, each pair of receptacle contacts being positioned in a corresponding shield box.

11. A mezzanine receptacle connector comprising:

a housing having a mating end configured to be mated with a mezzanine header connector and a mounting end configured to be mounted to a circuit board, the mating end being opposite the mounting end, the housing being elongated along a longitudinal axis;

receptacle contacts held by the housing, the receptacle contacts being arranged in pairs carrying differential signals, the receptacle contacts having mating ends with deflectable spring beams for termination to corresponding header contacts of the mezzanine header connector, the receptacle contacts having terminating ends extending from the mounting end of the housing for termination to the circuit board; and a ground lattice held by the housing, the ground lattice providing electrical shielding for the pairs of receptacle contacts with each pair of receptacle contacts being electrically shielded from each other pair of receptacle contacts by the ground lattice, the ground lattice comprising longitudinal receptacle ground shields extending longitudinally within the housing generally parallel to the longitudinal axis and aligned with associated receptacle contacts to provide electrical shielding therefore, and the ground lattice comprising lateral receptacle ground shields extending laterally within the housing generally perpendicular to the longitudinal axis and aligned with associated receptacle contacts to provide electrical shielding therefore, the longitudinal receptacle ground shields being mechanically and electrically connected to the lateral receptacle ground shields to form the ground lattice, each longitudinal receptacle ground shield having a pair of deflectable spring beams extending from a planar base, the pair of deflectable spring beams being generally longitudinally aligned with the deflectable spring beams of the associated pair of receptacle contacts, each lateral receptacle ground shield having a pair of deflectable spring beams extending from a planar base, the pair of deflectable spring beams of the lateral receptacle ground shield being spaced generally equidistant from each of the deflectable spring beams of the associated pair of receptacle contacts.

12. The mezzanine receptacle connector of claim 11, wherein the longitudinal receptacle ground shields include tabs engaging corresponding lateral receptacle ground shields to electrically connect the longitudinal receptacle ground shields with the lateral receptacle ground shields.

13. The mezzanine receptacle connector of claim 11, wherein the lateral receptacle ground shields include tabs engaging corresponding longitudinal receptacle ground shields to electrically connect the lateral receptacle ground shields with the longitudinal receptacle ground shields.

14. The mezzanine receptacle connector of claim 11, wherein the ground lattice forms shield boxes with a pair of longitudinal receptacle ground shields on respective opposites sides of the corresponding shield box and with a pair of lateral receptacle ground shields on respective opposite sides of the corresponding shield box, each pair of receptacle contacts being positioned in a corresponding shield box.

15. The mezzanine receptacle connector of claim 11, wherein a plurality of the longitudinal receptacle ground shields are connected by bridges to form a longitudinal receptacle ground shield strip, the housing holding a plurality of longitudinal receptacle ground shield strips.

16. The mezzanine receptacle connector of claim 15, wherein the longitudinal receptacle ground shield strip includes channels aligned with the bridges between adjacent longitudinal receptacle ground shields, the channels receiving lateral receptacle ground shields.

17. The mezzanine receptacle connector of claim 11, wherein a plurality of the lateral receptacle ground shields are connected by bridges to form a lateral receptacle ground shield strip, the housing holding a plurality of lateral receptacle ground shield strips.

18. The mezzanine receptacle connector of claim 17, wherein the lateral receptacle ground shield strips include channels aligned with the bridges between adjacent lateral receptacle ground shields, the channels receiving longitudinal receptacle ground shields.

* * * * *